US012522965B2

(12) United States Patent
White et al.

(10) Patent No.: US 12,522,965 B2
(45) Date of Patent: Jan. 13, 2026

(54) LAUNDRY ASSEMBLY AND DISPENSER DRAWER REMOTE USER INTERFACE

(71) Applicant: Haier US Appliance Solutions, Inc., Wilmington, DE (US)

(72) Inventors: Robert Turner White, Louisville, KY (US); John Andrew Schmelz, Charlestown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 109 days.

(21) Appl. No.: 18/634,719

(22) Filed: Apr. 12, 2024

(65) Prior Publication Data

US 2025/0320650 A1 Oct. 16, 2025

(51) Int. Cl.

| | |
|---|---|
| ***D06F 34/28*** | (2020.01) |
| ***D06F 39/08*** | (2006.01) |
| *D06F 105/58* | (2020.01) |

(52) U.S. Cl.

CPC ..... *D06F 34/28* (2020.02); *D06F 39/083* (2013.01); *D06F 2105/58* (2020.02)

(58) Field of Classification Search

CPC ..... D06F 34/28

See application file for complete search history.

(56) References Cited

U.S. PATENT DOCUMENTS

| | | | |
|---|---|---|---|
| 6,684,111 | B2 | 1/2004 | Klein et al. |
| 7,136,940 | B2 | 11/2006 | Roh et al. |
| 8,051,381 | B2 | 11/2011 | Ebrom et al. |
| 8,432,299 | B2 | 4/2013 | Richter |
| 8,606,180 | B2 | 12/2013 | Santinato et al. |
| 8,677,246 | B2 | 3/2014 | Shin et al. |
| 8,786,412 | B2 | 7/2014 | Ebrom et al. |
| 10,119,714 | B2 | 11/2018 | Amer et al. |
| 10,378,140 | B2 | 8/2019 | Del Pos et al. |
| 10,705,494 | B2 | 7/2020 | Ha |
| 11,221,596 | B2 | 1/2022 | Fisher et al. |
| 2014/0191856 | A1 | 7/2014 | Cho et al. |
| 2018/0254959 | A1 | 9/2018 | Mantyjarvi et al. |
| 2020/0106635 | A1 | 4/2020 | Yoon et al. |

FOREIGN PATENT DOCUMENTS

| | | | |
|---|---|---|---|
| CN | 100465371 | C | 3/2009 |
| CN | 109269211 | A | 1/2019 |
| CN | 109793470 | A | 5/2019 |
| CN | 116163106 | A | 5/2023 |
| EP | 3617382 | B1 | 9/2021 |
| JP | 2021081969 | A | 5/2021 |
| WO | WO2011128745 | A2 | 10/2011 |

*Primary Examiner* — Jason Y Ko

(74) *Attorney, Agent, or Firm* — Dority & Manning, P.A.

(57) ABSTRACT

A laundry appliance and laundry system are provided. The laundry appliance includes a cabinet including a drawer attachable within a front panel. A first user interface panel is positioned at the front panel and includes a display and an input selector. An operational component configured to perform a duty cycle. A controller is operably coupled to the first user interface panel and the operational component. The controller is communicatively coupled to the first user interface and is configured to receive a user input for operating the operational component. A second user interface panel is positioned at the drawer. The second user interface panel is positioned adjacent to the first user interface panel. A power supply module is operably coupled to the second user interface panel.

20 Claims, 9 Drawing Sheets

LAUNDRY ASSEMBLY AND DISPENSER DRAWER REMOTE USER INTERFACE

FIELD OF THE INVENTION

The present subject matter relates generally to laundry appliances. The present subject matter relates particularly to structures and methods for controlling laundry appliances.

BACKGROUND OF THE INVENTION

Vertically stacked appliance arrangements facilitate efficient use of space. One example of a vertically stacked arrangement includes a dryer appliance stacked on top of a washing machine appliance. Vertically stacked appliances present certain challenges. For instance, the controls of many consumer appliances are located at or near the top of the unit. Accordingly, reaching the controls of the stacked appliance may be difficult for some users. Thus, controlling a stacked appliance may be inconvenient. In addition to vertically stacked appliance arrangements, some appliance systems or groups are arranged such that the controls of one or more of the appliances are difficult to access or reach. Controlling such difficult-to-access appliances may be inconvenient as well.

For instance, including controls for multiple appliances at a single user interface can cause confusion as to which controls and functions apply to which appliance.

In another instance, including controls for one or more appliances at a remote device, such as a smartphone or tablet, can require a user to have their remote device physically available in order to operate the appliances. Requiring access to a remote device to operate the appliances can be inconvenient. Additionally, or alternatively, requiring access to a remote device to operate the appliances can cause the remote device to be a source of issues separate from the appliance, such as damage or interface issues at the remote device.

Accordingly, a laundry appliance and methods for controlling a laundry system that address one or more of the challenges noted above would be beneficial and advantageous.

BRIEF DESCRIPTION OF THE INVENTION

Aspects and advantages of the invention will be set forth in part in the following description, or may be obvious from the description, or may be learned through practice of the invention.

An aspect of the present disclosure is directed to a laundry appliance. The laundry appliance includes a cabinet including a drawer attachable within a front panel. A first user interface panel is positioned at the front panel and includes a display and an input selector. An operational component configured to perform a duty cycle. A controller is operably coupled to the first user interface panel and the operational component. The controller is communicatively coupled to the first user interface and is configured to receive a user input for operating the operational component. A second user interface panel is positioned at the drawer. The second user interface panel is positioned adjacent to the first user interface panel. A power supply module is operably coupled to the second user interface panel.

Another aspect of the present disclosure is directed to a laundry system. The laundry system includes a first laundry appliance including a cabinet. The cabinet includes a front panel including an opening into which a drawer is attachable within the front panel. A first user interface panel is positioned at the front panel. The first user interface panel includes a display and an input selector. A first operational component is configured to perform a first duty cycle. The first laundry appliance includes a first controller operably coupled to the first user interface panel and the first operational component. The first controller is communicatively coupled to the first user interface and configured to receive a first user input for operating the first operational component. The first laundry appliance includes a second user interface panel positioned at the drawer. A power supply module is operably coupled to the second user interface panel through a data port at the drawer. The laundry system includes a second laundry appliance including a second operational component configured to perform a second duty cycle. The second laundry appliance includes a second controller operably coupled to the second operational component. The second controller is configured to receive a second user input from the second user interface panel through the data port at the drawer of the first laundry appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
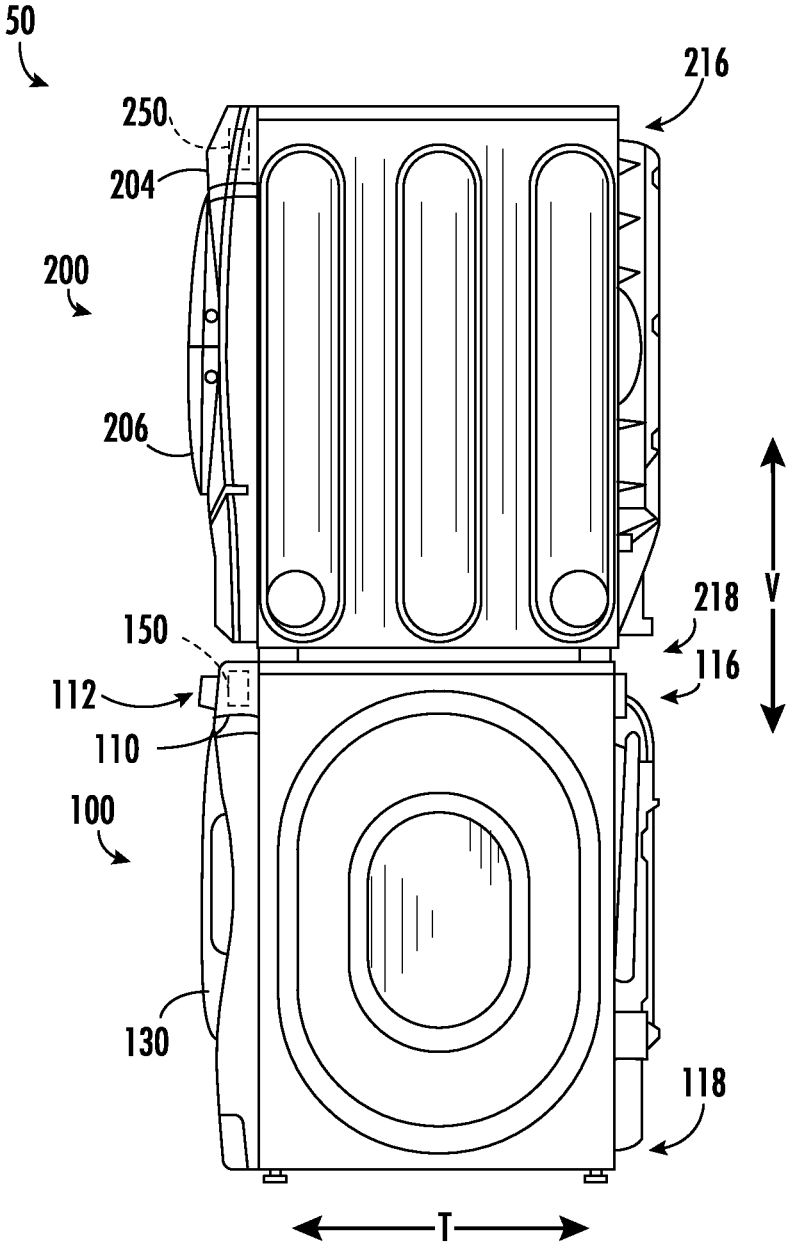
FIG. 1 provides a side view of an appliance system that includes a dryer appliance stacked on a washing machine appliance in accordance with an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
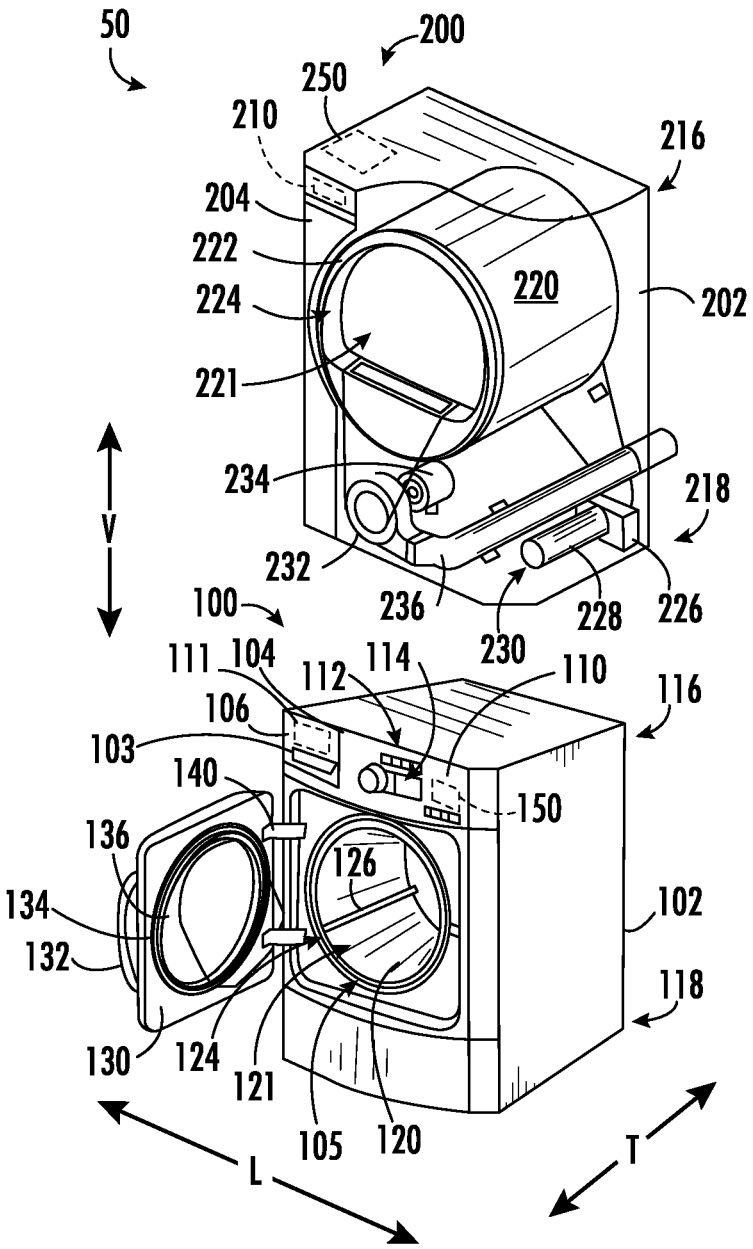
FIG. 2 provides an exploded, perspective view of the appliance system of FIG. 1 depicting a door of the washing machine appliance in an open position and the dryer appliance shown partially cutaway.

FIGS. 1 and 2 provide an exemplary appliance system (or assembly) 50 in accordance with an exemplary embodiment of the present subject matter. FIG. 1 provides a side elevation view of appliance system 50. FIG. 2 provides an exploded perspective view of appliance system 50. As shown, appliance system 50 includes a first appliance 100 and a second appliance 200. For this embodiment, the first appliance 100 is a washing machine appliance and the second appliance 200 is a dryer appliance stacked thereon. Generally, appliance system 50 defines a vertical direction V, a lateral direction L, and a transverse direction T. The vertical direction V, lateral direction L, and transverse direction T are mutually perpendicular and form an orthogonal direction system.

Figure 3:
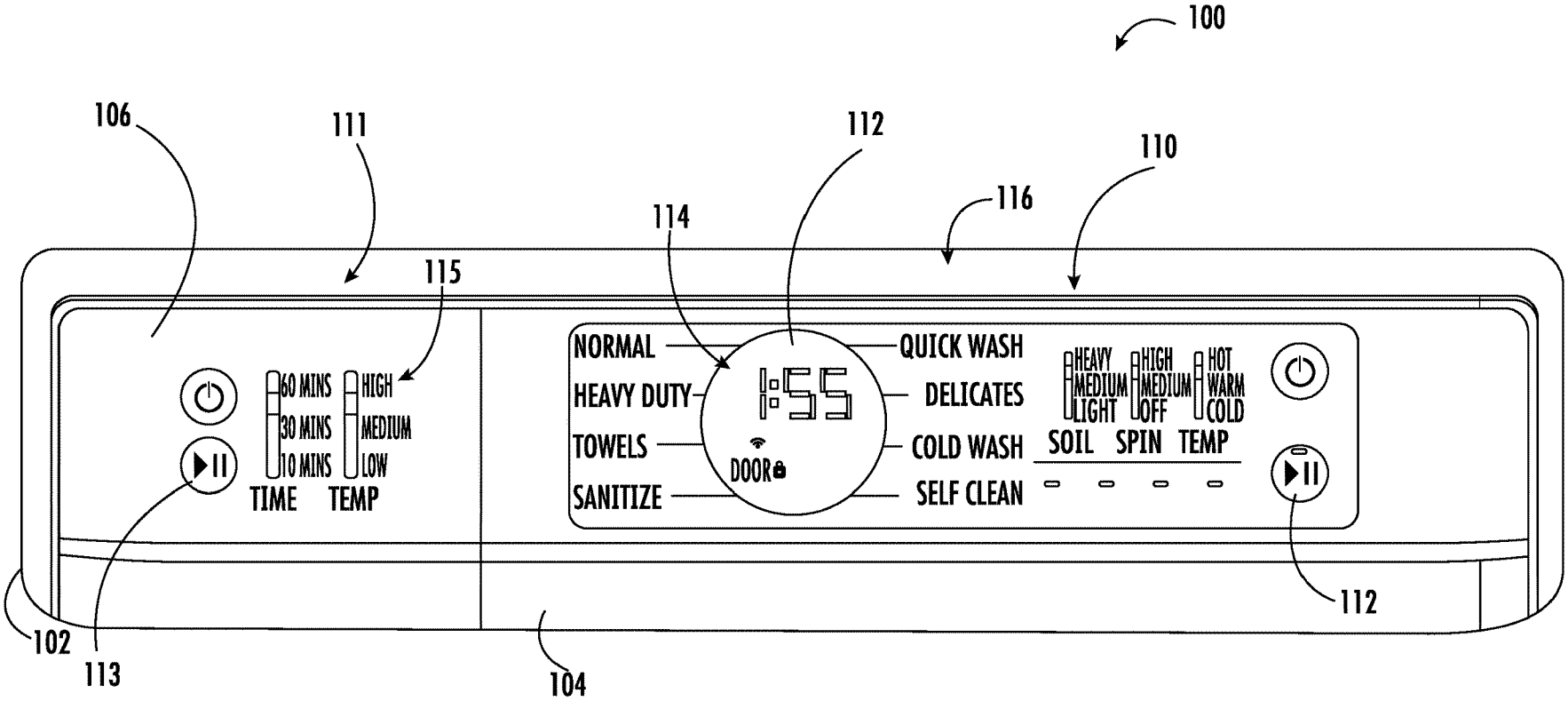
FIG. 3 provides a front view of a portion of a front panel of an appliance in accordance with an exemplary embodiment of the present disclosure.
Figure 4:
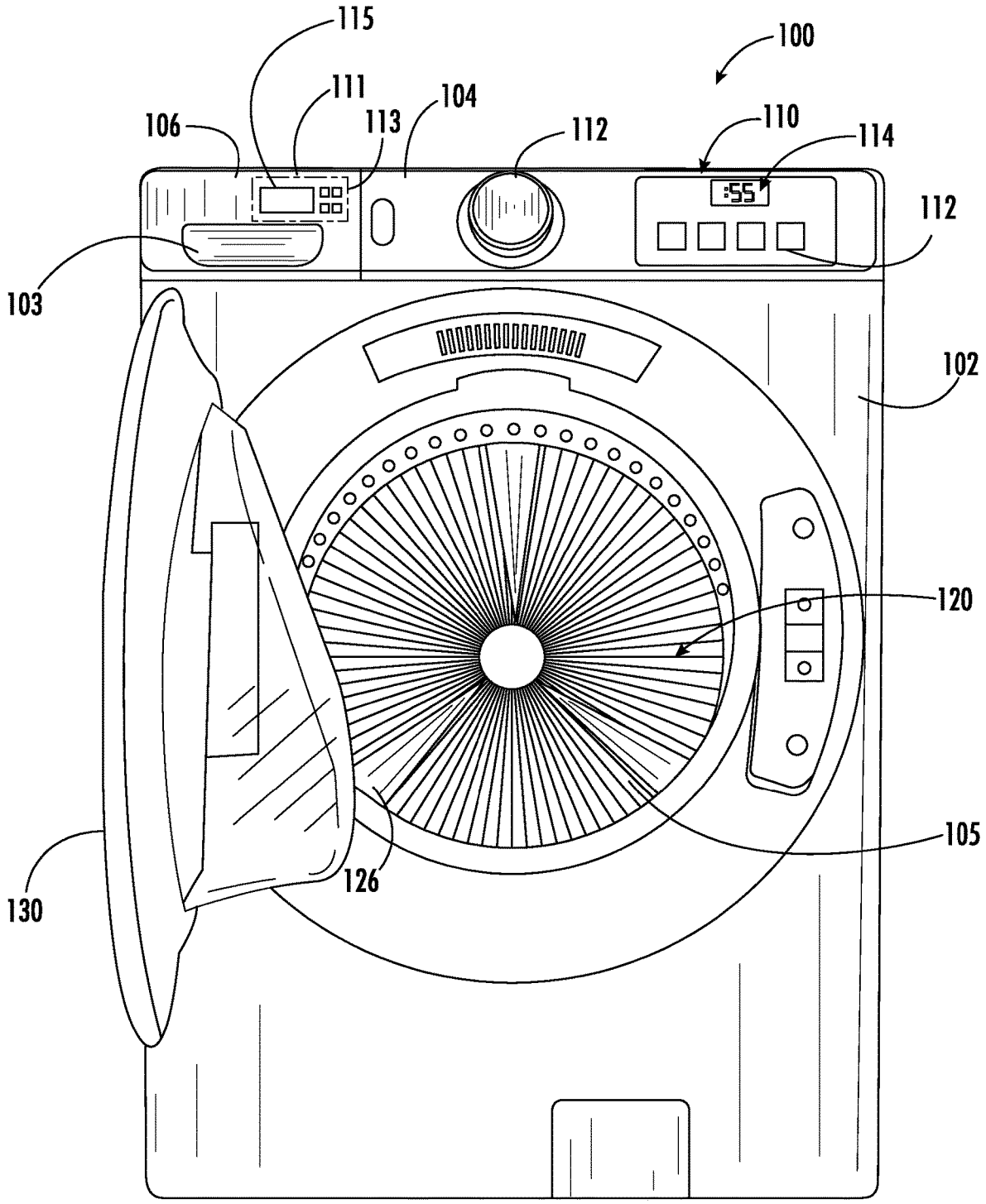
FIG. 4 provides a front view of a washing machine appliance, depicting a door in an open position, in accordance with an exemplary embodiment of the present disclosure.

FIG. 3 provides a front view of an exemplary portion of a front panel 104 of the first appliance 100, including a first user interface 110, and a second user interface 111 positioned at drawer 106, in accordance with an exemplary embodiment of the present subject matter. FIG. 4 provides a front view of an exemplary first appliance 100 including an embodiment of the front panel 104 in accordance with an exemplary embodiment of the present subject matter.

The exemplary first appliance 100 depicted in FIGS. 1-4 is a horizontal axis washing machine appliance. However, while described in the context of a specific embodiment of horizontal axis washing machine appliance arranged in a stacked fashion with the second appliance 200 forming a dryer appliance, using the teachings disclosed herein, it will be understood that the horizontal axis washing machine appliance is provided by way of example only. Other washing machine appliances having different configurations, different appearances, and/or different features may also be utilized with the present subject matter as well.

First appliance 100 has a cabinet 102 with a drum 120 rotatably mounted therein. Cabinet 102 extends between a top 116 and a bottom 118, e.g., along the vertical direction V. Cabinet 102 also extends between a first side and a second side, e.g., along the lateral direction L, and between a front portion and a rear portion, e.g., along the transverse direction T. An operational component forming a motor (not shown) is in mechanical communication with drum 120 in order to selectively rotate drum 120. For example, drum 120 may selectively rotate during an agitation or a rinse cycle of the washing machine appliance. In various embodiments, drum 120 defines a wash chamber 121 that is configured for receipt of articles for washing. Ribs 126 extend from drum 120 into wash chamber 121. Ribs 126 may assist with agitation of articles disposed within wash chamber 121 during operation of washing machine appliance 100. For example, ribs 126 may lift articles disposed in drum 120 during rotation of drum 120. Drum 120 also defines a plurality of holes 124. Holes 124 are configured to permit a flow of wash fluid between an interior of drum 120 and an exterior of drum 120 (e.g., between drum 120 and a tub of washing machine appliance 100).

Figure 5:
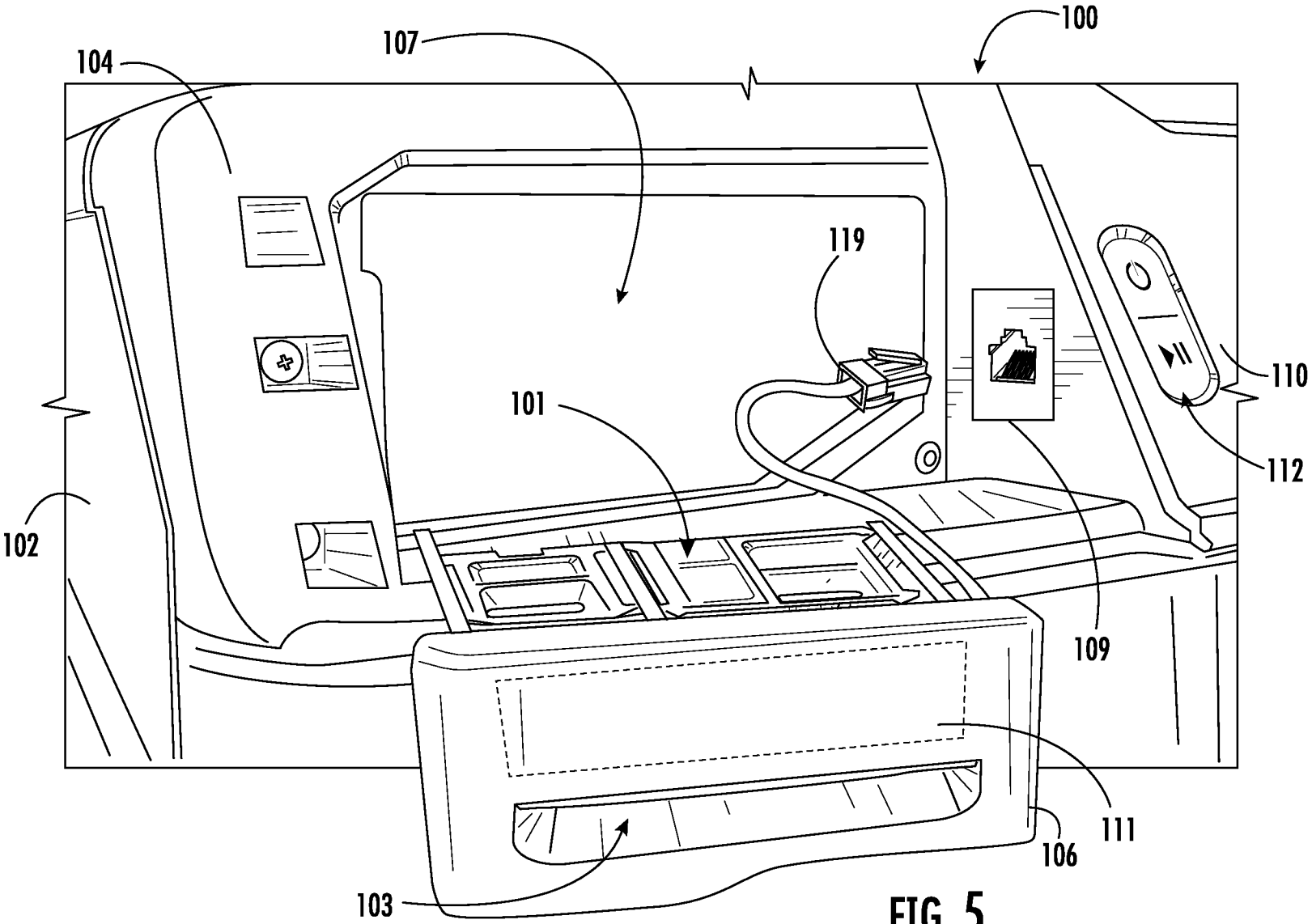
FIG. 5 provides a perspective view of a portion of an embodiment of a front panel, with a drawer removed for clarity, depicting a data port and bus in accordance with an exemplary embodiment of the present disclosure.

Referring to FIGS. 1-4, and further depicted in FIG. 5, cabinet 102 of first appliance 100 has a front panel 104. A drawer 106 is slidably mounted within front panel 104. For instance, drawer 106 may include rollers, rails, or other devices generally understood for facilitating articulation of a drawer from a cabinet. Drawer 106 includes a reservoir 101 for receiving dry or fluid detergent and/or other fluid additives (e.g., fabric softener or bleach) and directs the contents to wash chamber 121 during operation of first appliance 100. Front panel 104 forms an opening 107 into which the drawer 106 is slidably mounted within the cabinet 102 at the front panel 104. Drawer 106 may include a handle 103 at which a user may articulate the drawer 106 into and out of the cabinet 102 (e.g., articulate along transverse direction T).

Front panel 104 defines a loading opening 105 that permits user access to wash chamber 121 of drum 120. A door 130 is rotatably mounted to front panel 104 with a hinge 140. Door 130 permits selective access to wash chamber 121. A window 136 in door 130 permits viewing of wash chamber 121, e.g., during operation of first appliance 100. Door 130 also includes a handle 132 that a user may pull when opening and closing door 130. Latch striker 134 is configured for selectively securing door 130 to a latch (not labeled) when door 130 is in a closed position.

Front panel 104 also includes a first user interface panel 110. First user interface panel 110 includes a plurality of input selectors 112 and a display 114. Display 114 of first user interface panel 110 indicates selected features, a countdown timer, and/or other items of interest to appliance users. In some embodiments, display 114 is a touchscreen, such as e.g., an LCD touchscreen. Input selectors 112 and display 114 collectively provide an interface for users to provide user inputs for operator selection of machine cycles and features. Particularly, in accordance with exemplary aspects of the present disclosure, input selectors 112 and display 114 of first user interface panel 110 collectively provide an interface for users to provide user inputs (e.g., first user inputs) for operator selection of machine cycles (e.g., washing machine cycles and modes) and features of first appliance 100.

Drawer 106 includes a second user interface panel 111. Second user interface panel 111 includes a plurality of input selectors 113 and a display 115. Display 115 of second user interface panel 111 indicates selected features, a countdown timer, and/or other items of interest to appliance users. In some embodiments, display 115 is a touchscreen, such as e.g., an LCD touchscreen. Input selectors 113 and display 115 collectively provide an interface for users to provide user inputs for operator selection of machine cycles and features. Particularly, in accordance with exemplary aspects of the present disclosure, input selectors 113 and display 115 of second user interface panel 111 collectively provide an interface for users to provide user inputs (e.g., second user inputs) for operator selection of machine cycles (e.g., dryer cycles and modes) and features of second appliance 200.

Referring briefly to FIG. 5, a portion of an exemplary embodiment of the first panel 104 of the first appliance 100 is provided, with drawer 106 removed to depict opening 107 and data port 109. First appliance 100 includes data port 109 positioned at opening 107 at the cabinet 102. In various embodiments, data port 109 is configured to transmit user inputs (e.g., second user inputs) or signals from the second user interface panel 111 to the controller 250 at the second appliance 200. Data port 109 may include a communications bus 119, such as a telecommunications cable (e.g., an ethernet cable or other appropriate communications interface with data port 109). Communications bus 119 is operably coupled to second interface panel 111 through drawer 106 to permit transmission of user inputs or signals received at the second interface panel 111 to controller 250 at second appliance 200. Data port 109 may include any suitable wired or wireless communications apparatus, such as a registered jack (RJ), ethernet port, or other telecommunications port or module. Communications bus 119 may include any suitable connection to the data port 109, such as a wired connection.

Operation of first appliance 100 is controlled by a controller 150 that is communicatively coupled with various components of first user interface panel 110. In this way, when a user manipulates input selectors 112 or display 114 to select machine cycles and features (e.g., washing machine cycles and modes), controller 150 operates the various components of first appliance 100 to execute selected machine cycles and features.

Operation of second appliance 200 is controlled by a controller 250 that is communicatively coupled with various components of second user interface panel 111 through data port 109. In this way, when a user manipulates input selectors 113 or display 115 to select machine cycles and features (e.g., dryer cycles and modes), controller 250 operates the various components of second appliance 200 to execute selected machine cycles and features.

In some example embodiments, controller 150, 250 may include one or more memory devices and one or more processing devices, such as general or special purpose microprocessors operable to execute programming instructions or micro-control code associated with operating first appliance 100 and second appliance 200, respectively. The memory device (i.e., memory) may represent random access memory, such as e.g., DRAM, or read only memory such as EEPROM or FLASH. In some embodiments, the one or more processing devices execute programming instructions stored in memory. The memory may be a separate component from the processor or may be included onboard within the processor. The memory can store information accessible to processing device, including instructions that can be executed by processing device. Optionally, the instructions can be software or any set of instructions that, when executed by the processing device, cause the one or more processing devices to perform operations. For some embodiments, the instructions include one or more software packages configured to operate first appliance 100 and second appliance 200 and interpret one or more electrical signals. For example, the instructions may include a software package configured to execute commands based on feedback from user controls, such as user inputs or signals. Controller 150, 250 may be positioned in a variety of locations throughout appliances 100, 200, respectively.

As illustrated in FIG. 2, controller 150 is located proximate first user interface panel 110 of first appliance 100. In such embodiments, input/output ("I/O") signals may be routed between controller 150 and various operational components of first appliance 100.

Referring still to FIG. 2, controller 250 is located at cabinet 202 of second appliance 200. In such embodiments, input/output ("I/O") signals may be routed between controller 250 and various operational components of second appliance 200.

First appliance 100 may be operated in a wash cycle in the following exemplary manner. Laundry items are loaded into wash chamber 121, and washing operation is initiated through operator manipulation of input selectors 112. Drum 120 is filled with water, and detergent and other additives are dispensed from drawer 106 to the wash chamber 121 to form a wash fluid with water at the drum 120. One or more valves (not shown) can be controlled by first appliance 100 to fill drum 120 to the appropriate level for the amount of articles being washed. Once drum 120 is filled with fluid to the desired level, the laundry items within wash chamber 121 are agitated with rotation of drum 120 and ribs 126 for cleansing the laundry items.

After the agitation phase of the wash cycle is completed, wash fluid is drained from drum 120. Laundry articles can then be rinsed by adding fluid to drum 120, depending on the cleaning cycle selected by a user. Ribs 126 and rotation of drum 120 may provide agitation within wash chamber 121. One or more spin cycles may also be used. A spin cycle may be applied after the wash cycle and/or after the rinse cycle in order to wring wash fluid from the articles being washed. During a spin cycle, drum 120 is rotated at relatively high speeds.

The exemplary second appliance 200 of appliance system 50 depicted in FIGS. 1 and 2 is a front load or horizontal axis dryer appliance. However, while described in the context of a specific embodiment of horizontal axis dryer appliance arranged in a stacked fashion or manner with first appliance 100, using the teachings disclosed herein it will be understood that horizontal axis second appliance 200 is provided by way of example only. Other dryer appliances having different configurations, different appearances, and/or different features may also be utilized with the present subject matter as well.

Second appliance 200 has a cabinet 202 and a drum 220 rotatably mounted therein. Drum 220 is mounted for rotation about a substantially horizontal axis (i.e., an axis that is substantially orthogonal to the vertical direction V). An operational component forming a motor (not shown) is in mechanical communication with drum 220 in order to selectively rotate drum 220. For example, drum 220 may selectively rotate during a drying cycle of second appliance 200. Drum 220 defines a drying chamber 221 that is configured for receipt of articles for drying. Tumbling ribs may extend from drum 220 into drying chamber 221 for tumbling of laundry articles during a drying cycle. Drum 220 is generally cylindrical in shape, having an imperforate outer cylindrical wall and a front flange or wall 222 defining an opening 224 to drum 220 for loading and unloading of laundry articles.

Cabinet 202 extends between a top 216 and a bottom 218, e.g., along the vertical direction V. Cabinet 202 also extends between a first side and a second side, e.g., along the lateral direction L, and between a front portion and a rear portion, e.g., along the transverse direction T. Cabinet 202 of dryer appliance 200 has a front panel 204. Various drawers may be slidably mounted within front panel 204. A door 206 (FIG. 1) is rotatably mounted to front panel 204, e.g., with a hinge. Door 206 permits selective access to drying chamber 221. A window in door 206 permits viewing of drying chamber 221, e.g., during operation of second appliance 200. Door 206 also includes a handle that a user may pull when opening and closing door 206. A latch assembly is configured for selectively securing door 206 in a closed position.

Furthermore, drum 220 includes a rear wall rotatably mounted with cabinet 202 by a suitable bearing. The rear wall of drum 220 defines a plurality of holes or apertures that receive hot air that has been heated by an electric heater 226 in communication with an air supply duct 228 and duct inlet 230. The air is moved from drum 220 by a blower fan 232, which is driven by a blower motor 234. The air may pass through a screen filter configured for trapping lint particles. As the air passes through the screen filter, the air enters a trap duct seal and is passed out of the clothes dryer through an exhaust duct 236. After the clothing articles have been dried, they are removed from drum 220 via opening 224.

In some embodiments, front panel 204 may include a third user interface panel 210. The third user interface panel 210 may include a plurality of input selectors and/or a display, such as described above in regard to user interface panel 111. The display of the user interface panel of second appliance 200 may indicate selected features, a countdown timer, and/or other items of interest to appliance users. In some embodiments, the display is a touchscreen, such as e.g., an LCD touchscreen. The input selectors and display may collectively provide an interface for users to provide user inputs for operator selection of machine cycles and features. For this embodiment, operation of dryer appliance 200 is controlled at least in part by controller 250. In some exemplary embodiments, in response to user manipulation of second user interface panel 111, user inputs or signals are communicated from the second user interface panel 111 at the first appliance 100 and generates and communicates a control command that is routed to controller 250, which in turn causes one or more operational components of second appliance 200 to execute selected machine cycles and features. In still some embodiments, in response to user manipulation of second user interface panel 111, user inputs or signals are communicated from the second user interface panel 111 at the first appliance 100 and generates and communicates a control command that is routed to controller 150 of first appliance 100, which in turn is routed to controller 250 of second appliance 200, and causes one or more operational components of second appliance 200 to execute selected machine cycles and features.

In some embodiments, however, second appliance 200 does not include a user interface panel (i.e., second appliance 200 does not include third user interface panel 210). For instance, second user interface panel 111 at first appliance 100 may remove a need for a user interface panel positioned at the second appliance 200. However, in various embodiments, second user interface panel 111 may permit positioning of controls for the second appliance 200 at the first appliance 100, such as to position control more accessibly along the vertical direction V. In still various embodiments, second user interface panel 111 at drawer 106 may provide a repair, replacement, or upgrade feature for a user interface panel at the second appliance 200 without requiring removal or disassembly of the user interface panel at the second appliance 200. In yet other embodiments, second appliance 200 includes only a controller 250 without a display or input selectors.

FIGS. 6-9 provide schematic block diagrams of exemplary embodiments of appliance system 300 in accordance with exemplary aspects of the present disclosure. For this embodiment, appliance system 300 includes a first appliance 301 and a second appliance 302 stacked thereon. For instance, system 300 may be the appliance system 50 of FIGS. 1-5. First appliance 301 may include one or more embodiments of first appliance 100 depicted and described herein, such as a washing machine appliance. Second appliance 401 may include one or more embodiments of the second appliance 200 depicted and described herein, such as a dryer appliance. In such embodiments, the washing machine appliance defines vertical direction V, and in such embodiments, the dryer appliance is stacked on top of the washing machine appliance along the vertical direction V. In some embodiments, the dryer appliance is positioned adjacent the washing machine appliance along the lateral direction L. That is, the washing machine appliance and dryer appliance may be placed side-by-side.

In other embodiments, first appliance 301 and second appliance 401 each form washing machine appliances. In other embodiments, first appliance 301 and second appliance 401 each form dryer appliances.

Generally, appliance system 300 includes features that allow a user to control second appliance 401 from or using a second interface panel separate from a first interface panel each positioned at first appliance 301. First appliance 301 includes one or more operational components 310 configured for performing a duty cycle, e.g., a wash cycle. For instance, in embodiments in which first appliance 301 is a washing machine appliance, operational components 310 may include a motor for rotating a drum (e.g., drum 120 in FIG. 2) about its axis of rotation. Operations components 310 may include a display (e.g., display 114 in FIG. 2) for displaying relevant duty cycle information to a user. Although two (2) operational components 310 are shown in FIGS. 6-9, first appliance 301 may include any suitable number of operational components 310.

First appliance 301 includes a first user interface 312 that includes one or more input selectors 314. In some exemplary embodiments, input selectors 314 may be rotary dials, push buttons, or one or more touchscreen inputs. In some embodiments, first user interface 312 of first appliance 301 also includes one or more displays 316. One or all of the displays 316 may be touchscreen displays in which a user may push or touch to control various aspects of first appliance 301.

First appliance 301 includes a second user interface 412 that includes one or more input selectors 414. In some exemplary embodiments, input selectors 414 may be rotary dials, push buttons, or one or more touchscreen inputs. In some embodiments, second user interface 412 at first appliance 401 also includes one or more displays 416. One or all of the displays 416 may be touchscreen displays in which a user may push or touch to generate user inputs or signals for controlling various aspects of the second appliance 401.

In various embodiments, first user interface 312 is configured such as depicted and described in regard to first user interface 110 in FIGS. 1-5. Second user interface 412 is configured such as depicted and described in regard to second user interface 111 in FIGS. 1-5. For instance, first appliance 301 includes drawer 306 at which second user interface 412 is positioned, such as described in regard to drawer 106. Drawer 306 is operably coupled to a data port 319. For instance, drawer 306 may include a communications bus (e.g., communications bus 119) configured to operably couple to a data port (e.g., data port 109) positioned at an opening through which the drawer 306 is received (e.g., opening 107 through front panel 104 of cabinet 102 in FIGS. 1-5).

In some embodiments, second appliance 401 may include a user interface 422 (e.g., third user interface). The user interface 422 at the second appliance 410 may include an input selector 424 and display 426, such as described in regard to input selectors and displays herein. However, it should be appreciated that the second user interface 412 such as described herein may remove a need for the user interface panel 422 at the second appliance 401, such as described herein.

As further shown in FIGS. 6-9, first appliance 301 includes a first controller 318 communicatively coupled with first user interface 312 and the operational components 310. First appliance 301 may be communicatively coupled with first user interface 312 and operational components 310 in any suitable manner, e.g., by a suitable wireless or wired connection.

First controller 318 may include a memory and processor, such as a general or special purpose microprocessor operable to execute programming instructions or micro-control code associated with a cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, first controller 318 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Second appliance 401 includes one or more operational components 410 for performing a duty cycle, e.g., a drying cycle. For instance, in embodiments in which second appliance 401 is a dryer appliance, operational components 410 may include a motor for rotating a drum (e.g., drum 220 in FIG. 2) about its axis of rotation. Operational components 410 may include a heater (e.g., heater 226 in FIG. 2), blower fan (e.g., blower fan 232 in FIG. 2), and/or motor (e.g., motor 234 in FIG. 2) to execute or perform the duty cycle of second appliance 401. Although two (2) operational components 410 are shown in FIGS. 6-9, second appliance 401 may include any suitable number of operational components 410. As further shown in FIGS. 6-9, second appliance 401 includes a second controller 418 for controlling the one or more operational components 410 of second appliance 401. Generally, second controller 418 is configured to run a high-level operating system for processing inputs from various control commands, e.g., received from second user interface 412, and causing the operational components 410 to perform various operations and functions, e.g., to perform a duty cycle. Further, controller 418 may process various feedback signals from the operational components 410 and one or more sensors of second appliance 401.

Second controller 418 may be communicatively coupled with operational components 410 in any suitable manner, e.g., by a suitable wireless or wired connection. In addition, second controller 418 is communicatively coupled with second user interface 412 of first appliance 301, such as through data port 319. In various embodiments, first controller 318 and second controller 418 each include respective communications devices 332, 432. Communications devices 332, 432 may be configured as any suitable wired or wireless communications module. For instance, communication device 332, 432 may be configured to emit and/or receive one or more signals (e.g., according to a predetermined pattern). For example, a wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between first appliance 301 and second appliance 401.

Figure 6:
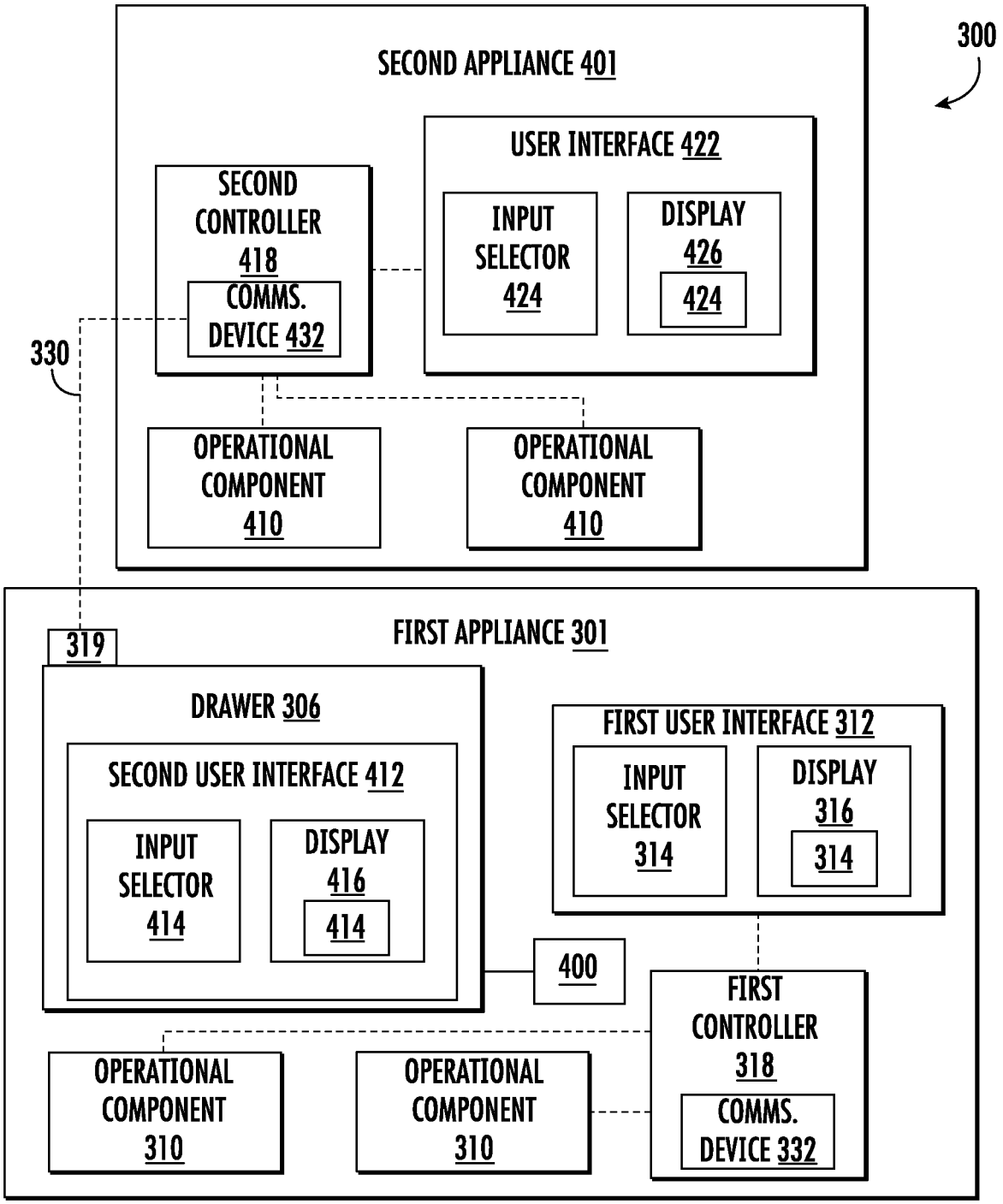
FIG. 6 provides a schematic block diagram of one exemplary appliance system in accordance with exemplary aspects of the present disclosure.

Referring to FIG. 6, in some embodiments, data port 319 is operably coupled to the second user interface 412 at drawer 306. A communications bus 330 communicatively connects the second user interface 412 at the first appliance 301 to the second controller 418 at the second appliance 401, such as through the second communications device 432. As described herein, second controller 418 is operably coupled to various operational components 410.

Communications bus 330 may communicatively couple the data port 319 at the first appliance 301 to the second controller 418 at the second appliance 401 via an Ethernet or LAN (Local Area Network) cable.

Figure 7:
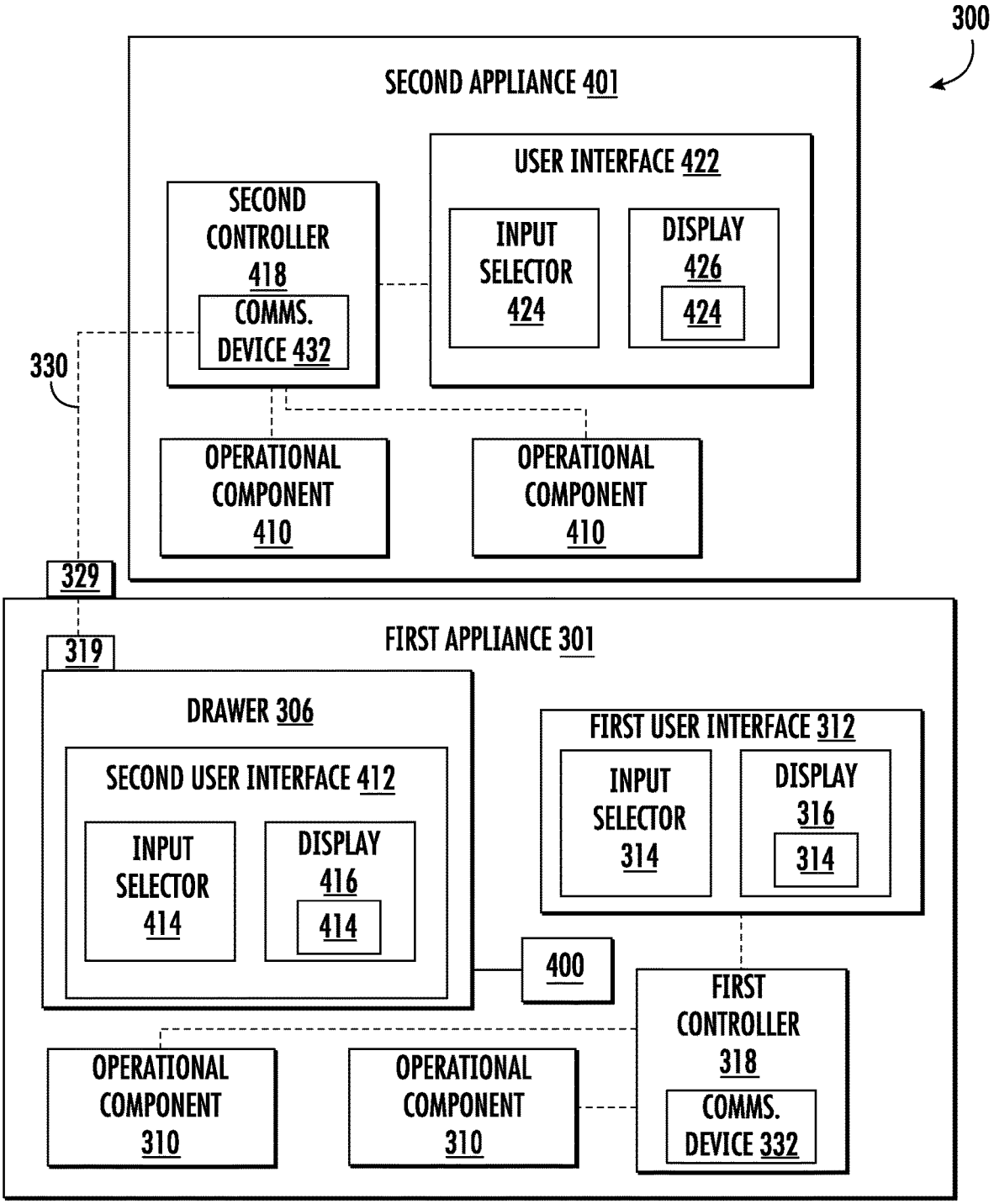
FIG. 7 provides a schematic block diagram of one exemplary appliance system in accordance with exemplary aspects of the present disclosure.

Referring to FIG. 7, in some embodiments, first appliance 301 may include a first data port 319, such as described in regard to data port 109 at opening 107 of the cabinet 102. First appliance 301 may include a second data port 329 positioned at the cabinet 102 (FIG. 2), such as at a rear portion or at a user panel. Communications bus 330 may communicatively couple the first data port 319 to the second data port 329. Communications bus 330 may further communicatively couple the second data port 329 at the first appliance 301 to the second controller 418 at the second appliance 401. For instance, second appliance 401 may include one or more data ports such as described herein for receiving a communications bus.

Figure 8:
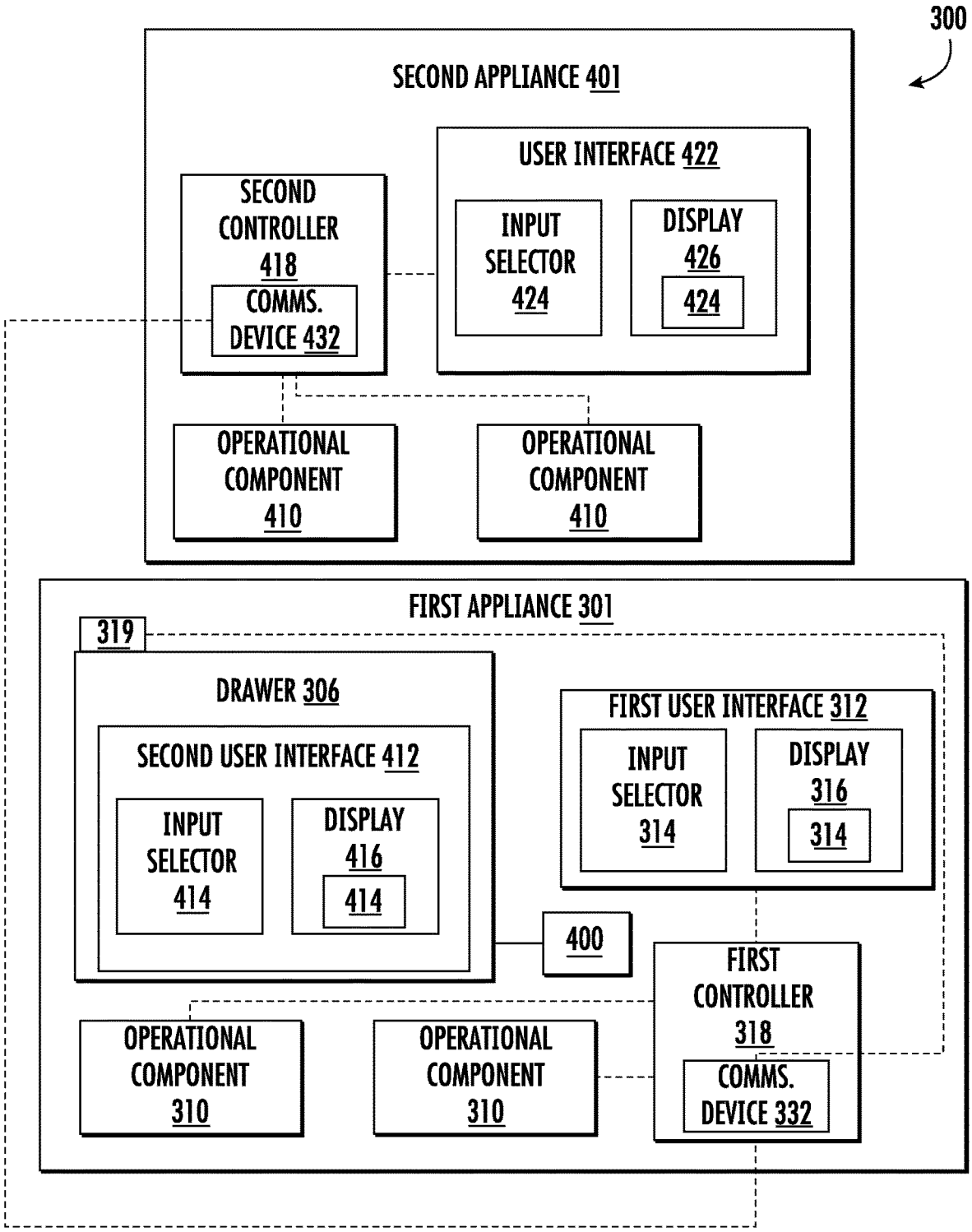
FIG. 8 provides a schematic block diagram of one exemplary appliance system in accordance with exemplary aspects of the present disclosure.

Referring to FIG. 8, in some embodiments, drawer 306 is communicatively coupled to the first controller 318 through data port 319. First controller 318 may be wired or wirelessly coupled in communication with second controller 418. For instance, communications devices 332, 432 may be linked via wireless communication (e.g., short wavelength communication) such as described herein. First communications device 332 may be configured to receive user inputs or signals from the second user interface 412, and transmit the signal to the second communications device 432 at the second appliance 401.

In various embodiments, the first appliance 301 includes a power supply module 400 operably coupled to the second user interface 412. The power supply module 400 may include any appropriate power supply device, such as configured to provide voltage/current for powering the second user interface 412. For instance, the power supply module 400 may include a battery, a capacitor, a driving system, or other component configured to provide, manipulate, or actuate a supply of voltage/current to a device. The power supply module 400 may further be operably connected to various components of the first appliance 301, as may generally be understood, for powering the first user interface 312, the first controller 318, and operational components 310.

Figure 9:
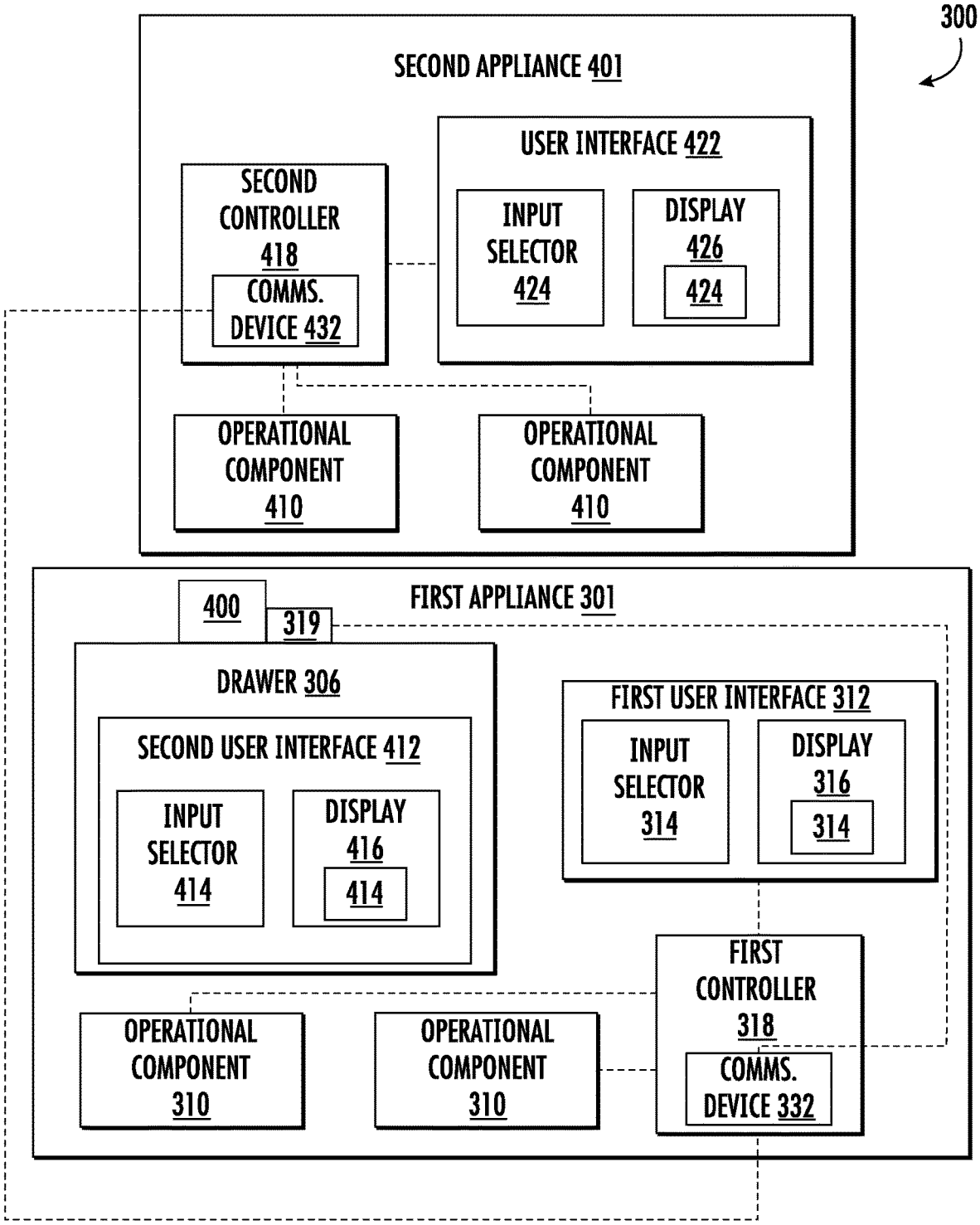
FIG. 9 provides a schematic block diagram of one exemplary appliance system in accordance with exemplary aspects of the present disclosure.

In some embodiments, such as depicted in FIG. 9, data port 319 is configured to transmit energy from the power supply module 400 through operable coupling of the second user interface 412 at the drawer 306 to the data port 319.

Embodiments of the appliances, and appliance system, including the drawer and user interfaces such as described herein may overcome one or more issues described herein. For instance, embodiments provided herein may facilitate moving a user interface panel along the vertical direction to position controls at a stacked appliance at an easier-to-access location. In another instance, embodiments provided herein may remove a need for a user interface panel at another appliance. In still another instance, embodiments provided herein may provide an upgrade by providing a customizable user interface at a replaceable dispenser drawer. In still various instances, embodiments provided herein may improve connectivity among a plurality of appliances without requiring remote computing devices, such as smartphones, tablets, laptop computers, or other devices.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance, comprising:

a cabinet, the cabinet comprising a front panel, the front panel comprising an opening into which a drawer is attachable to the cabinet within the front panel;

a first user interface panel positioned at the front panel, the first user interface panel comprising a display and an input selector;

an operational component configured to perform a duty cycle;

a controller operably coupled to the first user interface panel and the operational component, the controller communicatively coupled to the first user interface and configured to receive a user input for operating the operational component;

a second user interface panel positioned at the drawer; and a power supply module operably coupled to the second user interface panel.

2. The laundry appliance of claim 1, comprising:

a data port positioned in the opening at the cabinet, wherein the data port is communicatively coupled to the controller to permit transmission of a signal from the data port to the controller, and wherein the drawer is releasably attachable to the data port to permit transmission of the signal from the second user interface panel to the controller.

3. The laundry appliance of claim 2, wherein the controller comprises a communications device, wherein the data port is communicatively coupled to the communications device to permit transmission of the signal from the second user interface panel to the communications device.

4. The laundry appliance of claim 3, wherein the communications device comprises a wireless communications module.

5. The laundry appliance of claim 2, wherein the data port comprises a registered jack.

6. The laundry appliance of claim 2, wherein the power supply module is operably coupled to the data port to transmit energy to the second user interface panel.

7. The laundry appliance of claim 1, comprising:

a first data port positioned in the opening at the cabinet; and a second data port positioned at the cabinet, wherein the first data port and the second data port are communicatively coupled to one another, and wherein the drawer is releasably attachable to the first data port to permit transmission of a signal from the second user interface panel to the second data port.

8. The laundry appliance of claim 1, wherein the laundry appliance is washing machine appliance, wherein the drawer is configured to receive a fluid and dispense the fluid to a wash chamber.

9. The laundry appliance of claim 1, wherein the first user interface panel is positioned adjacent along the front panel to the second user interface panel.

10. A laundry system, comprising:

a first laundry appliance comprising a cabinet, the cabinet comprising a front panel, the front panel comprising an opening into which a drawer is attachable within the front panel, wherein a first user interface panel is positioned at the front panel, the first user interface panel comprising a display and an input selector, and wherein a first operational component is configured to perform a first duty cycle, and wherein the first laundry appliance comprises a first controller operably coupled to the first user interface panel and the first operational component, the first controller communicatively coupled to the first user interface and configured to receive a first user input for operating the first operational component, and wherein the first laundry appliance comprises a second user interface panel positioned at the drawer, and wherein a power supply module is operably coupled to the second user interface panel through a data port at the drawer; and a second laundry appliance comprising a second operational component configured to perform a second duty cycle, wherein the second laundry appliance comprises a second controller operably coupled to the second operational component, wherein the second controller is configured to receive a second user input from the second user interface panel through the data port at the drawer of the first laundry appliance.

11. The laundry system of claim 10, wherein the first laundry appliance comprises a washing machine appliance, wherein the drawer is configured to receive a fluid and dispense the fluid to a wash chamber.

12. The laundry system of claim 11, wherein the second laundry appliance comprises a dryer appliance.

13. The laundry system of claim 10, wherein the data port at the drawer interfaces with the cabinet at the opening.

14. The laundry system of claim 13, wherein the data port is communicatively coupled to the first controller to permit transmission of the second user input from the data port to the first controller, and wherein the drawer is releasably attachable to the data port to permit transmission of the second user input from the second user interface panel to the controller.

15. The laundry system of claim 14, wherein the first controller comprises a first communications device, wherein the data port is communicatively coupled to the first communications device to permit transmission of the second user input from the second user interface panel to the first communications device.

16. The laundry system of claim 15, wherein the second controller comprises a second communications device, wherein the second communications device is communicatively coupled to the first communications device at the first controller.

17. The laundry system of claim 16, wherein the first and second communications devices comprise a wireless communications module.

18. The laundry system of claim 10, wherein the data port comprises a registered jack.

19. The laundry system of claim 10, wherein the power supply module is operably coupled to the data port to transmit energy to the second user interface panel.

20. The laundry system of claim 10, wherein the data port comprises a first data port positioned in the opening at the cabinet, and a second data port positioned at the cabinet, wherein the first data port and the second data port are communicatively coupled to one another, and wherein the drawer is releasably attachable to the first data port to permit transmission of the second user input from the second user interface panel to the second data port, and wherein the second data port is communicatively coupled to the second controller to transmit the second user input from the second user interface panel to the second controller.

* * * * *